US005937596A

United States Patent [19]

Leeuwenburgh et al.

[11] Patent Number: 5,937,596

[45] Date of Patent: Aug. 17, 1999

[54] WEATHER BARRIER FOR WINDOWS AND DOORS

[75] Inventors: Peter Leeuwenburgh, Herwijnen, Netherlands; Randy T. Lear, Medina, Ohio

[73] Assignee: Manco, Inc., Avon, Ohio

[21] Appl. No.: 08/966,325

[22] Filed: Nov. 7, 1997

Related U.S. Application Data

[63] Continuation-in-part of application No. 08/906,836, Aug. 6, 1997.

[51] Int. Cl.[6] ..... E06B 3/26

[52] U.S. Cl. ..... 52/202; 52/222; 160/354; 160/368; 428/354; 428/40.1; 428/294

[58] Field of Search ..... 52/202, DIG. 13, 52/14, 222; 49/61; 428/40, 212, 214, 354, 343, 124, 192, 40.1, 41.8, 194, 352, 906; 118/504, 505; 160/354, 369

[56] References Cited

U.S. PATENT DOCUMENTS

| | | | |
|---|---|---|---|
| 4,249,589 | 2/1981 | Loeb | 160/368 |
| 4,510,986 | 4/1985 | Schwankl | 160/354 |
| 4,562,675 | 1/1986 | Baigas, Jr. et al. | 52/202 |
| 4,911,964 | 3/1990 | Corbo . | |
| 5,354,614 | 10/1994 | Cox . | |
| 5,383,312 | 1/1995 | St. Louis et al. | 52/63 |
| 5,466,500 | 11/1995 | Pluim | 428/40 |
| 5,468,538 | 11/1995 | Nameche | 428/101 |
| 5,616,385 | 4/1997 | Rothrum et al. | 428/40.1 |
| 5,626,928 | 5/1997 | Summer | 428/41.8 |
| 5,654,055 | 8/1997 | Cox et al. | 428/41.7 |
| 5,747,131 | 5/1998 | Kreckel | 428/40.1 |

FOREIGN PATENT DOCUMENTS

| | | |
|---|---|---|
| 548 576 | 11/1992 | European Pat. Off. . |
| 90 02 023 | 2/1990 | Germany . |
| 90 02 023 | 7/1990 | Germany . |
| 39 12 161 | 10/1990 | Germany . |
| 41 41 041 | 1/1996 | Germany . |
| 7-8857 | 1/1995 | Japan . |
| 8-108474 | 4/1996 | Japan . |
| 7-31908 | 5/1998 | Japan . |
| 6-262108 | 6/1998 | Japan . |

OTHER PUBLICATIONS

Manco, Inc. sell sheet for "Pre–Taped Painting Drop Cloths."

International Search Report dated Dec. 23, 1998.

*Primary Examiner*—Christopher Kent
*Assistant Examiner*—Yvonne Horton-Richardson
*Attorney, Agent, or Firm*—Vickers, Daniels & Young

[57] ABSTRACT

A weather barrier kit is provided comprising double-faced tape used to bond a film to a window frame and a folded and rolled sheet of film having a stiffening band and strip of adhesive across the top. The provision of a stiffening band with adhesive thereon across the top of the film allows one to apply the film squarely, without stretching and without the need of measuring beforehand.

11 Claims, 2 Drawing Sheets

WEATHER BARRIER FOR WINDOWS AND DOORS

This application is a continuation in part of application Ser. No. 08/906,836, filed Aug. 6, 1997, entitled A Cover Sheet for Painting and Lacquering Jobs.

BACKGROUND OF THE INVENTION

This invention relates to the art of weather barriers and more particularly to a weather barrier and method of installing a weather barrier comprising a thin plastic film adhesively mounted around a window or door.

Weather barriers for windows and doors in homes and other buildings have been available for many years. Traditional heavy storm windows and storm doors are often permanently or seasonally mounted in a window frame or a door frame. In some instances, plastic film is used in place of or in addition to traditional storm windows and storm doors.

Window insulator kits which include the parts necessary to create a film weather barrier have been sold for several years. Often these window insulator kits comprise a roll of double-faced adhesive tape and a quantity of plastic film. The tape is first applied around the periphery of the window frame. An appropriate size piece of plastic film is laid out on a flat surface, cut and applied to the double-sided tape. The film is then shrunk (by use of heat) into place. While this arrangement has been successful, it has many problems. The consumer must measure the window or door opening to be protected, lay out and cut the film to cover and overlap this opening. The quantity of film supplied in the kits often consists of one very large folded piece. A sheet of film measuring 62 inches by 210 inches is sometimes contained in window insulator kits. Unfolding such a large sheet is often challenging. Laying out and cutting of the sheets the appropriate size often proves difficult for consumers. One had to take measurements of the window or door to be protected, unfold the film to the appropriate size on a large surface, transfer the measurements, and make appropriate square cuts. Because the film is thin and very flexible, measuring it and cutting it could be difficult. This is especially true when dealing with large window or door openings. The film picks up dirt when it is laid out. Fingerprints often were placed on the film. The double-sided tape, even with a parting sheet applied is relatively thin and flexible. This often results in the consumer applying the tape in other than a straight line. It is then difficult to apply the large film sheet to the door in a square manner. The film itself is stretchy, thin and flexible. Even if one applies the double-sided tape to the window or door frame in a relatively straight manner, applying the film in a square manner is difficult. Folds and creases can develop in the film as it is applied. The film can be applied slightly askew with respect to the square of the tape making it difficult to smooth and also sometimes resulting in the consumer believing that he has a piece which is too small. Some window insulator kits caution the consumer to apply the tape and then gently apply the film. If the film was misapplied it was lifted and reapplied correctly prior to applying full pressure. This often results in more fingerprints. Installation of prior art insulating kits often required two cutting steps. First, the consumer cut the film to approximately the size of the window being treated. After the film was applied to the window, the consumer was expected to trim the film to a finish size by cutting around all four sides. Thus, while these storm window kits were generally effective, inexpensive and usually easy to apply, significant problems in application and consumer frustration were still present.

INCORPORATION BY REFERENCE

A prior art weather barrier kit is described in U.S. Pat. No. 4,911,964 to Corbo, et al. which is incorporated herein by reference.

SUMMARY OF THE INVENTION

In accordance with the present invention, a weather barrier and method of applying a weather barrier are provided which minimizes or overcomes the disadvantages described above while maintaining the advantages of film weather barriers, namely ease of use and low expense.

More particularly in accordance with the present invention, a weather barrier system includes a double-faced adhesive tape having one side adherable to the door or window frame and the other side adherable to the stretchable plastic film. A plastic film is provided folded and rolled with a stiffening band fixed to the sheet along its top edge with adhesive on one side of the stiffening band for attaching the band to the door or window frame.

Still further in accordance with the present invention, the plastic sheet material is folded with folds parallel to the top of the sheet and stiffening band and then rolled such that the stiffening band is rolled upon itself with the adhesive facing inward.

Yet further in accordance with the present invention, the stiffening band attached to the sheet material is significantly thicker and stiffer than the sheet material itself and eases application of the sheet material in a straight and square manner across the top of the window or door being protected.

Yet further in accordance with the present invention, a method of applying a weather barrier to a door or window is provided in which the consumer is provided with a sheet of plastic material having a stiffening band fixed to the top of the material in a roll form, the consumer unrolls the sheet material while applying it to the top of the window or door to be protected, trims the folded sheet material to an appropriate width while still folded, unfolds the sheet material to full length, adheres the sides and bottom of the sheet to the window or door being protected, and trims the bottom of the sheet prior to shrinking the entire assembly into place.

It is the primary object of the present invention to provide a weather barrier for doors and windows which is easily applied by consumers, inexpensive, durable, and removable.

It is a further object of the present invention to provide a weather barrier in kit form which can be applied in a reduced number of steps by a consumer.

It is yet another object of the present invention to provide a weather barrier in kit form which facilitates applying the weather barrier in an orientation square to the window or door being protected.

It is still another object of the present invention to provide a weather barrier in kit form facilitating the application of the weather barrier top in a horizontal straight orientation thereby facilitating the orientation and trimming of the entire assembly.

It is still another object of the present invention to provide a weather barrier in kit form which facilitates application without wrinkles and sags.

It is still another object of the present invention to provide a weather barrier in kit form having a film with a stiffening strip at its top which has sufficient stiffness to facilitate applying in a straight line while being flexible enough to accommodate irregularities and be easily packaged.

It is yet another object of the present invention to provide a weather barrier kit in which a film can be applied to a window without first being laid out on a flat surface and cut whereby the film is kept clean.

It is still another object of the present invention to provide a method for applying a weather barrier in kit form which does not require the consumer to layout and cut a plastic film to size before application.

It is still another object of the present invention to provide a weather barrier in kit form which is economical and simple to install and easily retailed.

These and other objects and advantages of the present invention will become apparent from the following detail description of the preferred embodiments thereof and from the accompanying drawings.

DESCRIPTION OF A PREFERRED EMBODIMENTS

Figure 1:
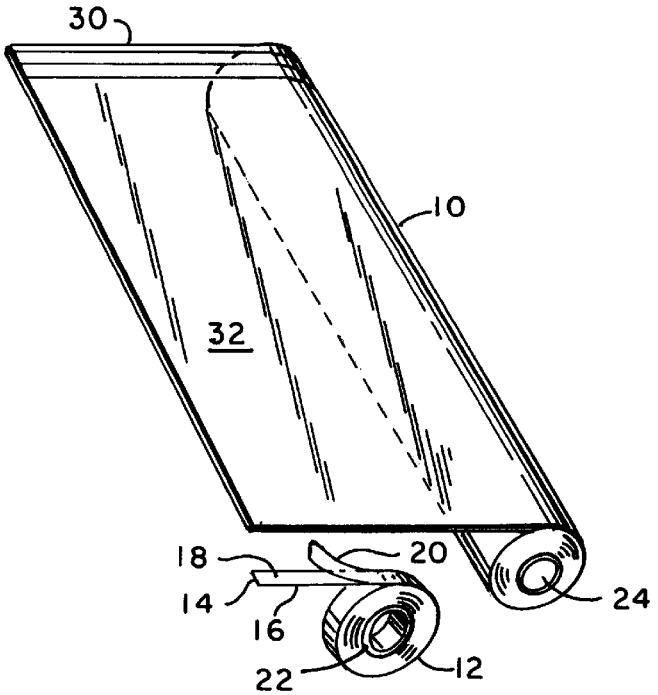
FIG. 1 is a perspective view of a roll of film and a roll of double-faced adhesive tape as will be purchased in kit form by the consumer in accordance with the present invention.

Referring now to the drawings wherein the showings are made for the purposes of illustrating preferred embodiments of the invention only and not for the purposes of limiting the invention. FIG. 1 illustrates a quantity of film 10 and double-faced adhesive tape 12. The tape 12 comprises a plastic substrate 14 having adhesive 16 applied to the inner side and adhesive 18 applied to the outer side. A parting layer 20 is applied to the outer side adhesive 18 allowing the tape to be rolled about a core 22 and unrolled as the consumer needs it. The tape 12 is often about ½" (13 mm) wide but other widths can also be selected. Double-faced adhesive tape as used in window insulating kits is conventional. The tape substrate, adhesive and parting sheet are all commercially available and the finished double-sided tape with parting sheet has also been commercially available for many years.

The film 10 is also rolled upon a core 24. The core 24 is a cardboard tube which supports the film 10 in its rolled condition both in manufacturing and in use by consumers.

Figure 2:
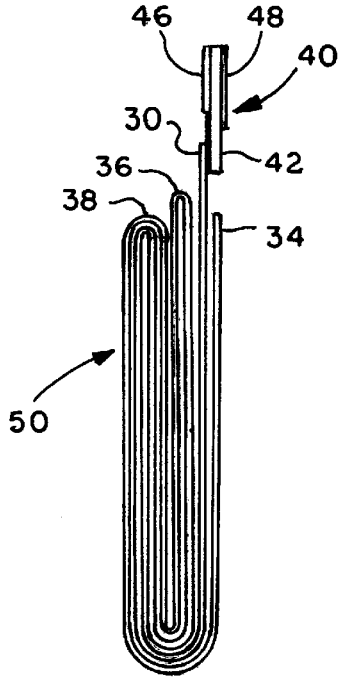
FIG. 2 is an end view greatly expanded in the lateral direction of the film and stiffening band seen in the roll in FIG. 1.

The body of the film 32 is folded upon itself several times as best seen in FIG. 2. The bottom of the film 34 is brought near the top of the film 30. Thus, the film is folded in half once. The first bottom fold 36 (which is actually the middle of the film) is then brought up near the top of the film 30. The second bottom fold 38 is then brought up near the top of the film 30. As can be seen in FIG. 2, this results in the body of film being folded with eight layers, one against the other. In this way, a body of film 32 having a top to bottom measurement of approximately 60" can be folded into eight layers approximately 7-½" in height. The individual layers of the body of film 32 are on the order of 0.75/1000" (0.75 mils or 0.019 mm) thick and therefore the folded layers are in total very thin and are easily rolled upon the core 24. The film 10 is rolled upon the core 24 in a tight spiral. The top 30 of the film 10 is rolled in a spiral at one end of the core 24. The body of film 32 is conventional composition and is virtually identical to the films heretofore used in window insulating kits.

The top 30 of the film is bonded to a stiffening band 40. The stiffening band 40 is bonded to the body of film 32 by adhesive bonding. Alternatively, heat welding or the like could be used. The band 40 is significantly thicker and stiffer than the film. In the preferred embodiment, the band 40 is a multilayer structure comprising a first adhesive tape 42 and a second adhesive tape 48 having a thickness of about 0.0085 mils. The first adhesive tape 42 is between 5 mils (5/1000 inch) and 8 mils (8/1000 inch) thick without adhesive and approximately one inch (2.54 cm) from top to bottom. The specific preferred adhesive tape 42 comprises a plastic film about 5 mils thick with an adhesive layer 46 about 1.25 mil thick on one side. An adhesive tape 42 is chosen which is easily rolled and deforms around irregularities when pressed against them. The top 30 of the film is fixed to the first adhesive tape 42 along the bottom quarter inch of the first adhesive tape 42 by pressing the top of the film against the adhesive 46.

Figure 3:
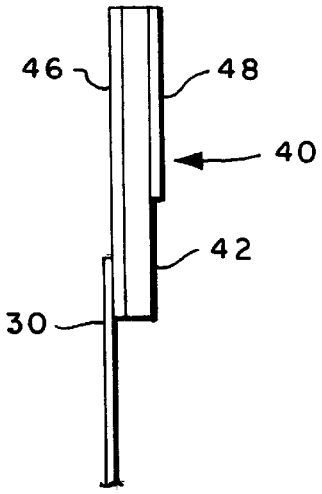
FIG. 3 is an end view of the very top portion of the roll of FIG. 1 showing the stiffening band and the other elements directly adjacent to the stiffening band in more detail.

On the side of the band 40 opposite the adhesive 46, a second adhesive tape 48 is provided. In the specific preferred embodiment, the second adhesive tape 48 is very thin. The tenacity of the bond between the adhesive on the second tape 48 and the first tape 42 is stronger than the bond between the adhesive 46 and the second tape 48. The second adhesive tape 48 has a height dimension less than the height dimension of the first tape 42, preferably about ⅝ inch (1.6 cm). The second adhesive tape 48 and the film 30 do not overlap. As best seen in FIG. 3, the top of the film 30 is fixed to the bottom ¼ inch of the first adhesive tape 42. A gap of about ⅛ inch exists between the bottom of the second tape 48 and the top of the film 30. When the film 10 is completely rolled up, the second adhesive tape 48 is on the side of the band 40 facing outwardly while the adhesive 46 of the first adhesive tape 42 faces inwardly. The adhesive 46 rests against the second tape 48 on the next layer inward on the roll. The adhesive will lightly adhere to the second tape 48 but easily separate therefrom when pulled away by a consumer. The second tape 48 on the other hand, is permanently adhered to the first tape 42 and will not pull away. The tape 42 and 48 are selected to provide strength, flexibility and adhesive properties as desired. Numerous appropriate tapes are commercially available.

As can be seen in FIG. 2, the uppermost portion of the top of the film 30 extends above the fold of the body of film 32. Extending above the top 30 of the film still further is the band 40. The thickness of the two adhesive tapes 42, 48 added together is about the same as, or slightly greater than, the thickness of the eight layers of film 32 in the folded condition. This allows the entire film-band assembly 50 to be wound upon the core 24 without any distortion. The height of the folds (7-½ inches) plus the height of the top of the film 30 and the band 40 allow the film-band assembly 50 to be wrapped around a 9 inch film core while providing 60 inches (5 feet) of height of film. If a higher film height, e.g. 84 inches for a storm door kit, is desired, one can add layers to the folded sheet 10 and use a thicker first adhesive tape 42 and/or second adhesive tape 48 so that the band 40 and folded sheet 10 are of the same thickness.

OPERATION

Figures 4, 5, 6:
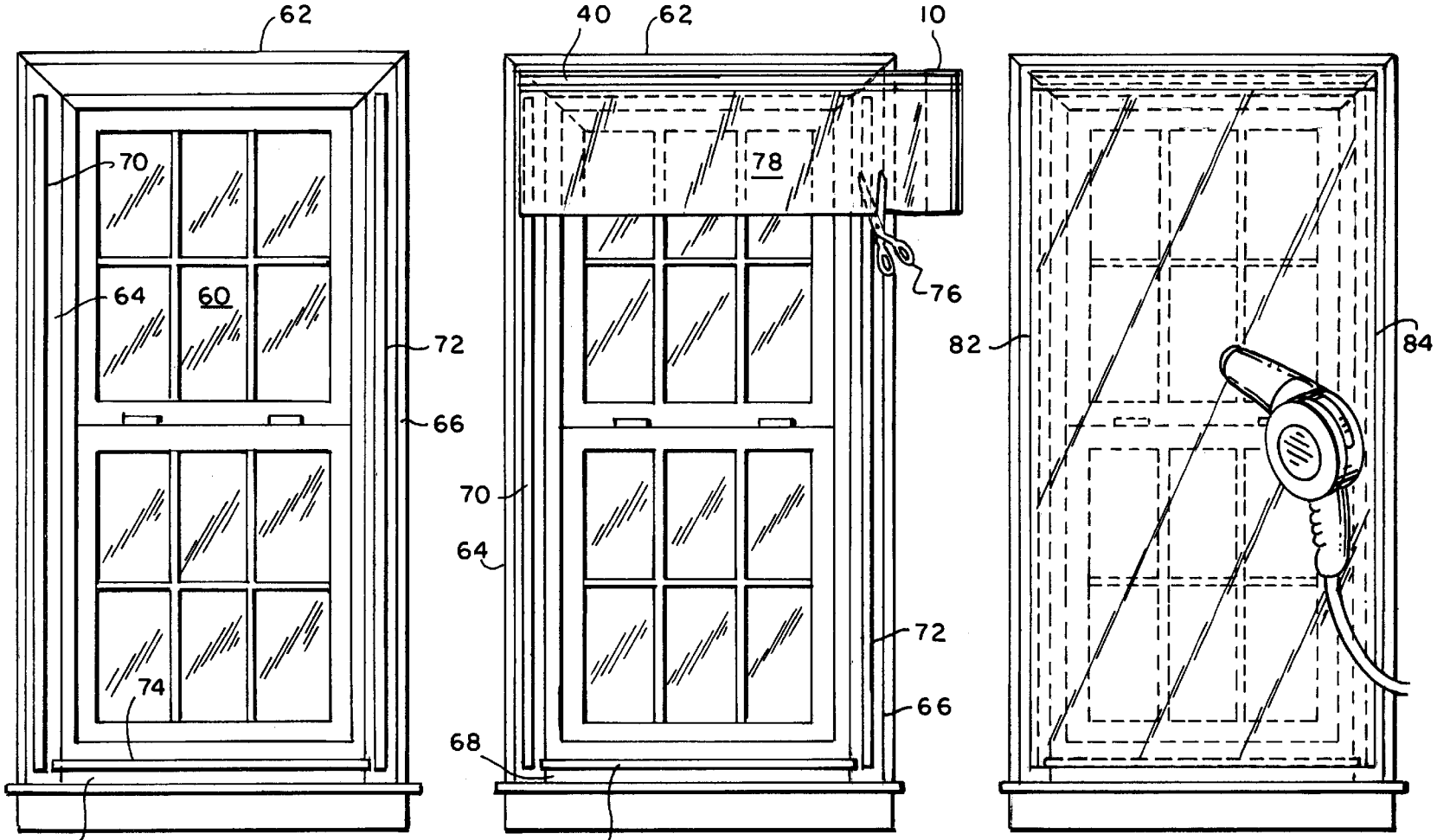
FIG. 4 is a plan view of a window to be protected in accordance with the present invention with the double-sided adhesive tape already applied to the sides and bottom of the window.
FIG. 5 shows the window of FIG. 4 after the initial application of the roll of film material just prior to the lateral cutting of the roll of film material.
FIG. 6 shows the window of FIGS. 4 and 5 after the roll of film material has been applied to the window and trimmed just prior to heat shrinking; and, FIG. 7 shows an alternate embodiment of the stiffening band in a view similar to FIG. 3.

The application of the weather barrier kit is illustrated in FIGS. 4, 5 and 6.

A window 60 is surrounded by a window frame having a window frame top 62, a window frame left side 64, a window frame right side 66, and a window frame bottom or sill 68. Strips of the double-faced adhesive tape 12 are applied over the full length of the left side and right side 64, 66 of the window frame. A strip of double-face tape 12 is also applied across the bottom of the window frame 68 or, if there is no convenient vertical bottom surface, across the horizontal surface of the sill. As is customary, the parting strip on the double-face tape is removed. Because the left side and right side 64, 66 of the window frame are straight and narrow, it is relatively easy to apply strips of tape 70, 72 in a straight and vertical manner. The bottom of the window frame 68 is also relatively straight and narrow and applying the bottom strip of tape 74 is also easy. Moreover, the straightness of the strips of tape 70, 72, 74 is not critical.

Referring now to FIG. 5, the rolled up film 10 is shown as it is applied across the window frame top 62. The leading edge of the film 10 is applied just outside of the lefthand tape strip 70. The band 40 is lightly pressed against the window frame top 62 with the adhesive 46 holding the band 40 against the window frame top 62. Because the band resists deformation in its plane, it is easily applied in a straight line. Thus, applying the band parallel to the top of the window frame 62 is easy. The roll of film 10 is unrolled and the band lightly adhered to the top of the window frame 62 such that the film extends beyond the right-hand tape strip 72. Scissors 76 or the like are then used to cut the roll perpendicular to the length of the band 40. The roll 10 is then set aside and the cut body of film 78 remaining upon the window 60 is unfolded. The band 40 is pressed against the top of the window frame forming a tight bond and the remaining body of film 78 smoothed and pressed against the side strips of tape 70, 72. Because the band 40 aids in proper alignment of the film 78, the side edges 82, 84 (FIG. 6) will align reasonably closely with the outside edges of the tape strips 70, 72. Moreover, because the band 40 prevents stretching or compression of the body of film 78 when it is applied across top, the width of the body of film between the two side edges 82, 84 will be uniform and proper over the entire height of the window. The bottom 86 of the cut film 78 is pressed against the bottom strip of double-faced adhesive 74 and trimmed as necessary. No measuring is required. The film has not been laid out on a table and has not picked up dust.

The adhered film is shrunk into place by application of heat through a heat gun resulting in an easily applied, clean, unwrinkled, transparent weather barrier over the window. When compared to conventional window insulator kits, the measuring and folding steps are avoided, wrinkles and misalignment due to skewing of the film with respect to the square of the window are avoided and wrinkles due to stretching and/or compression of the film as it is applied are minimized. Dust and fingerprints on the film are avoided. A much simpler and more predictable application of a weather barrier results.

Figure 7:
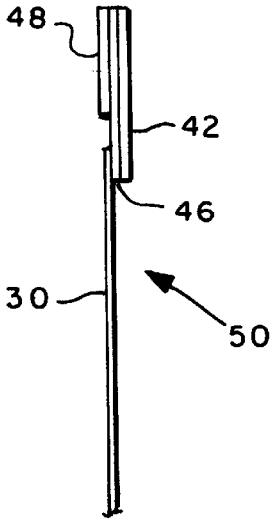

A second embodiment of the band 40 is shown in FIG. 7. In the second embodiment, the second adhesive tape 48 is on the same side of the first adhesive tape 42 as the top of the film 30. The adhesive side 46 of the second adhesive tape 48 is exposed when the film-band assembly 50 is unrolled. This allows one to select a first adhesive tape 42 with adhesive characteristics appropriate for retaining the second adhesive tape 48 and the film 10; and, a second adhesive tape 48 with adhesive characteristics appropriate for a particular window or door finish. Tape thickness and physical characteristics, e.g. tensile strength and flexibility, can be selected as desired.

The invention has been described with reference to preferred embodiments. Obviously, modifications and alterations will occur to others upon the reading and understanding of the specification and it is intended to include such modifications and alterations insofar as they come within the scope of the appended claims or the equivalents thereof.

Having thus described the invention, it is so claimed:

1. A window insulator kit comprising:

a quantity of tape having a front side and a back side and adhesive on both said front side and said back side;

a rectangular sheet of transparent thin flexible film having a top edge and a bottom edge, said film being folded parallel to said top and bottom edges such that said top edge remains exposed and said film is disposed in several layers;

a narrow band substantially stiffer than said sheet being bound to said top edge of said sheet, said band having a first side and a second side; and, an adhesive on one of said first and second sides, said band and folded sheet being rolled parallel to said sheet top edge.

2. The window insulator kit of claim 1 wherein said band is substantially thicker than said film.

3. The window insulator kit of claim 2 wherein said film is approximately 0.75 mil (0.00075 inch) thick, said film is folded in eight layers and said band is greater than approximately 6 mils (0.006 inch) thick.

4. The window insulator kit of claim 1 wherein said band and folded sheet is rolled such that said adhesive bearing side of said band faces inwardly.

5. The window insulator kit of claim 1 wherein said film is heat shrinkable.

6. The window insulator kit of claim 1 wherein said band comprises a first adhesive tape having an adhesive side, a non-adhesive side and a first transverse dimension said film being bound to said first adhesive tape by adhesion to said adhesive side over a portion of said first transverse dimension only; and, a second adhesive tape having a second transverse dimension less than said first transverse dimension; said second adhesive tape adhering to said non-adhesive side of said first adhesive tape over a portion of said first transverse dimension only.

7. The window insulator kit of claim 1 wherein said band comprises a first adhesive tape having a first transverse dimension and a second adhesive tape having a second transverse dimension bound to said first adhesive tape, said film being bound to said first adhesive tape over a third transverse dimension, the total of said second transverse dimension and said third transverse dimension being less than said first transverse dimension whereby said second adhesive tape and said film do not overlap.

8. A method of adding an insulating film layer to a window having a frame, a bottom, two sides, and a top comprising the steps of:

providing a roll of tape having a front side and a back side and adhesive on both said front side and said back side;

providing a rectangular sheet of transparent thin flexible film having a top edge and a bottom edge, said film being folded parallel to said top edge forming several layers such that said top edge remains exposed, said top edge having a stiff narrow band bonded thereto over its entire length, said band having a front side, a back side and an adhesive on one of said front and back sides, said folded sheet and said band being rolled into a tight spiral parallel to said band length;

applying lengths of said tape to said frame bottom and sides;

applying said rectangular sheet of film to said frame top by applying the adhesive on said band to said top near one of said frame sides and unrolling said folded sheet and applying the adhesive to said top across said top from said one side to the other side;

trimming said band and said folded sheet so that said trimmed sheet is slightly wider than the distance between said lengths of tape applied to said frame sides;

unfolding said sheet of film; and, pressing said film against said lengths of tape.

9. The method of claim 8 comprising the additional step of shrinking said applied film by means of heat.

10. A window insulator kit comprising:

a quantity of tape having a front side and a back side and adhesive on both said front side and said back side adapted to fix a film to a substrate;

a rectangular sheet of thin flexible film having a top edge and a bottom edge substantially parallel to said top edge, said film being folded substantially parallel to said top edge such that said top edge remains exposed; and, a continuous band of adhesive proximate to and parallel to said top edge of said sheet adapted to fix said top edge to a substrate.

11. The window insulator kit of claim 10 wherein said band of adhesive is carried on a plastic band fixed to said film which stiffens said top edge.

* * * * *